US010060617B2

(12) United States Patent
Horng et al.

(10) Patent No.: US 10,060,617 B2
(45) Date of Patent: Aug. 28, 2018

(54) LAMP AND AIR-GUIDING RING THEREOF

(71) Applicant: Sunonwealth Electric Machine Industry Co., Ltd., Kaohsiung (TW)

(72) Inventors: Alex Horng, Kaohsiung (TW); Chien-Chih Chen, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 0 days.

(21) Appl. No.: 14/230,079

(22) Filed: Mar. 31, 2014

(65) Prior Publication Data

US 2015/0176833 A1 Jun. 25, 2015

(30) Foreign Application Priority Data

Dec. 19, 2013 (TW) ..... 102147216 A
Mar. 4, 2014 (TW) ..... 103107266 A

(51) Int. Cl.

*F21V 33/00* (2006.01)
*F21V 15/01* (2006.01)
*F24F 13/078* (2006.01)
*F21S 8/02* (2006.01)

(52) U.S. Cl.

CPC ..... *F21V 33/0088* (2013.01); *F21V 15/01* (2013.01); *F24F 13/078* (2013.01); *F21S 8/026* (2013.01)

(58) Field of Classification Search

CPC ..... F24F 13/078; F24F 13/08; F24F 13/081; F24F 13/082; F24F 13/084

See application file for complete search history.

(56) References Cited

U.S. PATENT DOCUMENTS

| | | | | |
|---|---|---|---|---|
| 5,664,872 | A | 9/1997 | Spearman et al. | |
| 7,470,043 | B2 | 12/2008 | Mehta | |
| 8,541,932 | B2 | 9/2013 | Horng | |
| 2011/0114296 | A1* | 5/2011 | Horng | H01L 23/467 165/104.34 |
| 2012/0008330 | A1* | 1/2012 | Horng | F21S 8/02 362/373 |
| 2012/0140489 | A1* | 6/2012 | Chung | F21V 3/02 362/368 |
| 2013/0010480 | A1* | 1/2013 | Wheelock | F21K 9/135 362/373 |
| 2013/0149128 | A1* | 6/2013 | Yin | F04D 25/0606 415/203 |
| 2014/0043810 | A1* | 2/2014 | Jo | F21V 13/04 362/235 |

FOREIGN PATENT DOCUMENTS

| | | | |
|---|---|---|---|
| CN | 2191966 | Y | 3/1995 |
| CN | 2835660 | Y | 11/2006 |
| CN | 102401250 | A | 4/2012 |

* cited by examiner

*Primary Examiner* — Elmito Breval
(74) *Attorney, Agent, or Firm* — Alan D. Kamrath; Kamrath IP Lawfirm, P.A.

(57) ABSTRACT

A lamp includes a lamp unit and an air-guiding ring. The lamp unit has a housing receiving a light-emitting element, as well as a fitted portion formed on an outer periphery of the housing. The air-guiding ring has an inner periphery forming a fitting hole and is fitted around the fitted portion of the lamp unit via the fitting hole. The air-guiding ring comprises a venting portion extending from an outer periphery to the inner periphery of the air-guiding ring.

18 Claims, 11 Drawing Sheets

LAMP AND AIR-GUIDING RING THEREOF

BACKGROUND OF THE INVENTION

1. Field of the Invention

The present invention generally relates to a lamp and an air-guiding ring thereof, and more particularly, to a lamp that can be used with a fan and fitted with an air-guiding ring in order to form a ventilation structure for the fan to provide a predetermined ventilation effect, as well as the air-guiding ring thereof.

2. Description of the Related Art

FIG. 1 shows a conventional lamp 7 disclosed by Taiwan Patent No. 200834019. Lamp 7 includes a lamp unit 71 and a fan housing 72. Fan housing 72 includes an air inlet 721 and an air outlet 722. An impeller 723 is installed in fan housing 72.

Lamp unit 71 and fan housing 72 may be mounted in a ceiling or a wall. An air pipe (not shown) may be connected to air outlet 722 of fan housing 72. In this arrangement, when impeller 723 rotates, impeller 723 draws air through lamp unit 71 and air inlet 721 and discharges the air via the air outlet 722 and the air pipe. As such, a desired ventilation effect can be achieved while the heat generated by lamp unit 71 is reduced.

However, said lamp 7 requires drilling a hole on the ceiling or wall for ventilation purposes of fan housing 72. Disadvantageously, it is inconvenient to install the lamp 7 into the ceiling or wall.

FIG. 2 shows another conventional lamp 8 with a discharging fan as disclosed by China Patent No. 200520064891.3. Said lamp 8 includes a cover 81 and a discharging fan 82. Cover 81 has a plurality of vents 811 and is coupled to a side of discharging fan 82. A chamber is formed between cover 81 and discharging fan 82. A light-emitting module (not shown) is received in the chamber. Cover 81 can be mounted in the ceiling or wall. As such, when discharging fan 82 rotates, air is guided into and out of said lamp 8 via the plurality of vents 811 to provide a desired ventilation effect.

However, cover 81 and discharging fan 82 must be assembled to each other, so that discharging fan 82 is able to smoothly guide air into and out of lamp 8. In this regard, lamp 8 requires complex assembly procedures among the cover 81, the discharging fan 82 and an illumination device, leading to an inconvenient assembly of lamp 8.

FIG. 3 shows a further conventional lamp 9 with a discharging fan as disclosed by China Patent No. 94204173.9. Said lamp 9 includes a centrifugal fan 91 coupled with a cover 92. Cover 92 may be coupled with a fluorescent tube (not shown) capable of emitting light. Cover 92 includes a plurality of inlets 921. Therefore, when said lamp 9 is installed in a ceiling or a wall, centrifugal fan 91 is able to draw air into and out of the plurality of inlets 921 to provide a desired ventilation effect.

However, since the plurality of inlets 921 is arranged on the surface of cover 92 in order for centrifugal fan 91 to smoothly guide air into and out of said lamp 9, the structural strength of cover 92 tends to be lower. Another disadvantage is that cover 92 has to be designed in a way that enables cover 92 to be coupled with the fluorescent tube. Thus, manufacturing of said lamp 9 is inconvenient.

SUMMARY OF THE INVENTION

It is therefore the objective of this invention to provide a lamp and an air-guiding ring thereof in which the air-guiding ring can be easily fitted around the lamp to effectively reduce the assembly complexity.

It is another objective of this invention to provide a lamp and an air-guiding ring thereof in which the air-guiding ring can be directly used with a fan to provide a predetermined ventilation effect without having to drill vents on the ceiling or wall.

It is a further objective of this invention to provide an air-guiding ring of a lamp that can be directly fitted around the lamp without having to change the structure of the lamp. Thus, a fan can be used with the air-guiding ring to provide a predetermined ventilation effect.

In an embodiment of the invention, a lamp comprising a lamp unit and an air-guiding ring is disclosed. The lamp unit has a housing receiving a light-emitting element, as well as a fitted portion formed on an outer periphery of the housing. The air-guiding ring has an inner periphery forming a fitting hole and is fitted around the fitted portion of the lamp unit via the fitting hole. The air-guiding ring comprises a venting portion extending from an outer periphery to the inner periphery of the air-guiding ring.

In a form shown, the venting portion is in the form of a plurality of openings, and a plurality of protrusions is formed on a face of the air-guiding ring. The protrusions are spaced from each other to form a respective opening between each two adjacent protrusions. The plurality of openings extends from the outer periphery to the inner periphery of the air-guiding ring.

In the form shown, the venting portion is in the form of a plurality of slits extending from the outer periphery to the inner periphery of the air-guiding ring.

In the form shown, the air-guiding ring is a ring with elastic expansion or shrinkage.

In the form shown, a plurality of positioning members is arranged on a face of the air-guiding ring.

In the form shown, each positioning member has an abutting face and a coupling face opposite to the abutting face, and the abutting face abuts with the fitted portion of the housing.

In the form shown, the abutting face is an arc-like face.

In the form shown, the lamp unit is coupled with a fan.

In the form shown, the housing comprises a decorative protrusion adjoining the fitted portion and covering the air-guiding ring.

In the form shown, an outer cover is arranged on the outer periphery of the air-guiding ring and coupled with the decorative protrusion of the housing.

In the form shown, at least one of the plurality of protrusion: includes an abutting protrusion, with the abutting protrusion closer to the inner periphery of the air-guiding ring than to the outer periphery of the air-guiding ring.

In the form shown, at least one of the plurality of protrusions includes a radial extension extending outwards from the outer periphery of the air-guiding ring in a radial direction.

In another embodiment of the invention, an air-guiding ring of a lamp is disclosed. The air-guiding ring has an inner periphery forming a fitting hole and a venting portion extending from an outer periphery to the inner periphery of the air-guiding ring.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
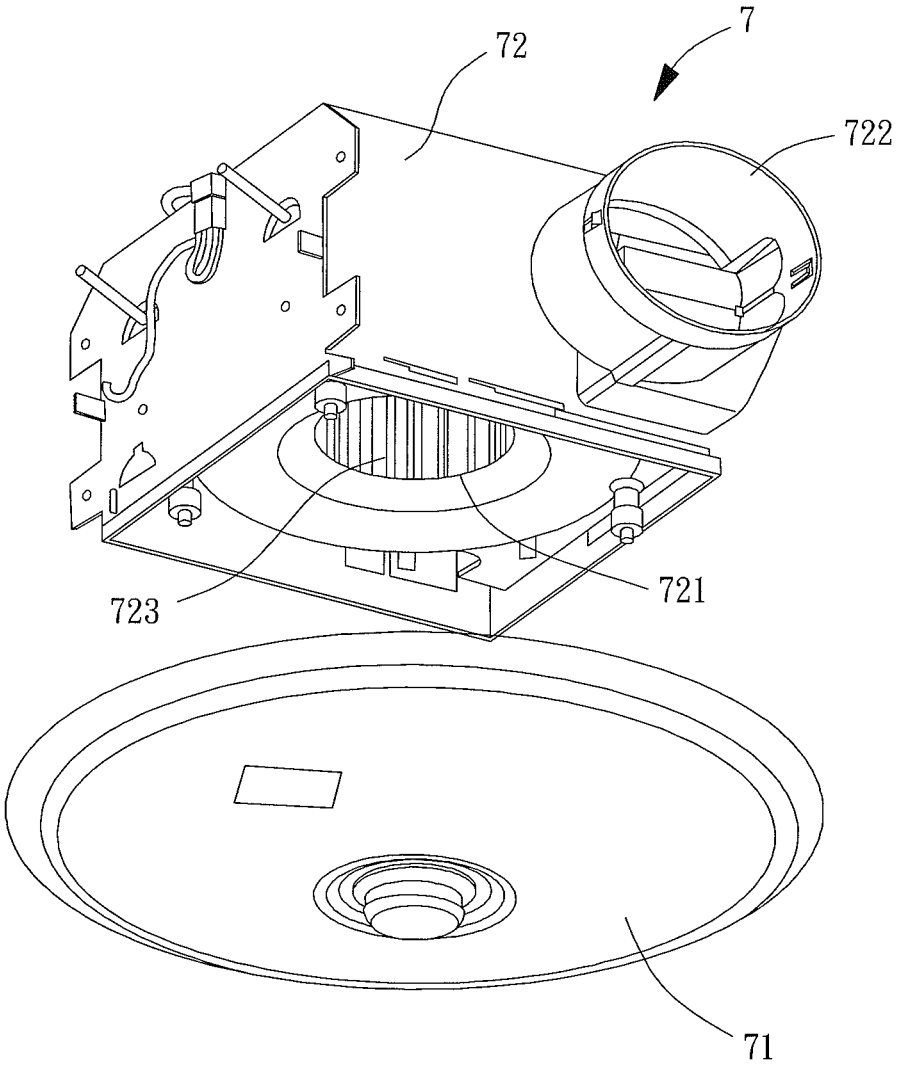
FIG. 1 PRIOR ART
FIG. 1 is an exploded view of a conventional lamp.
Figure 2:
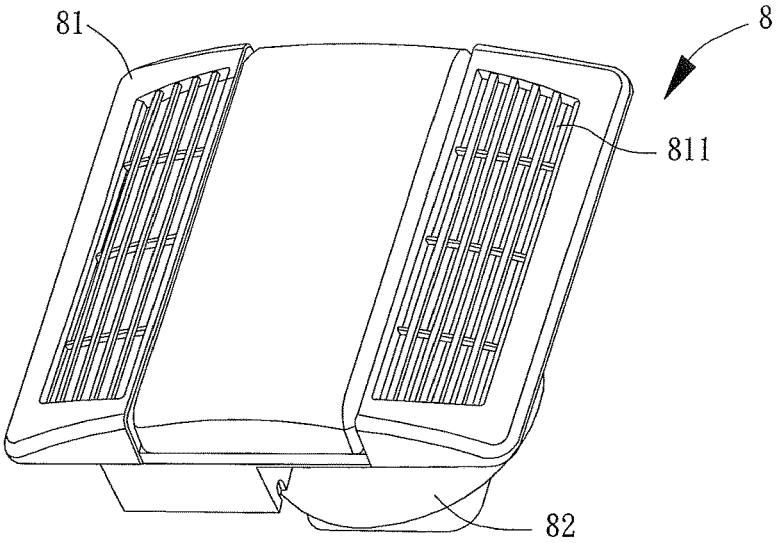
FIG. 2 PRIOR ART
FIG. 2 shows another conventional lamp.
Figure 3:
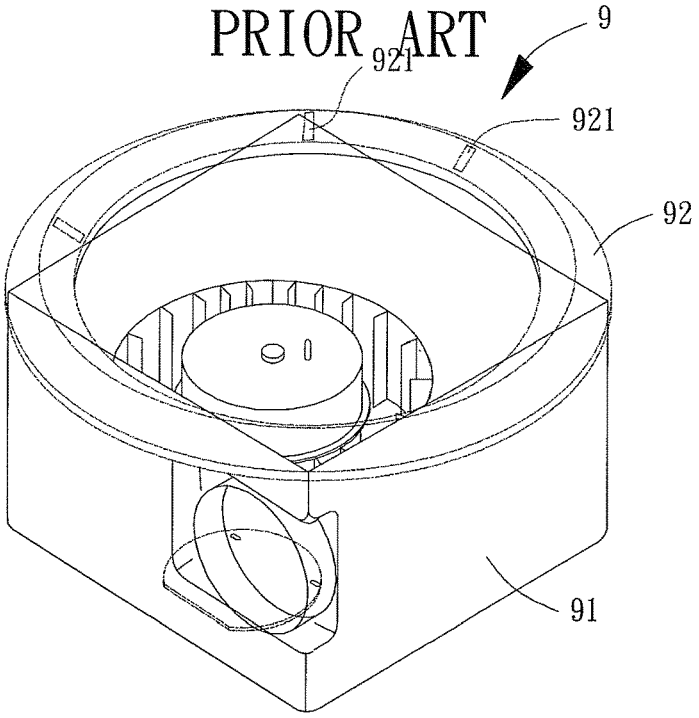
FIG. 3 PRIOR ART
FIG. 3 is a perspective view of a further conventional lamp.

In the various figures of the drawings, the same numerals designate the same or similar parts. Furthermore, when the terms "first", "second", "third", "fourth", "inner", "outer", "top", "bottom", "front", "rear" and similar terms are used hereinafter, it should be understood that these terms have reference only to the structure shown in the drawings as it would appear to a person viewing the drawings, and are utilized only to facilitate describing the invention.

DETAILED DESCRIPTION OF THE INVENTION

Figure 4:
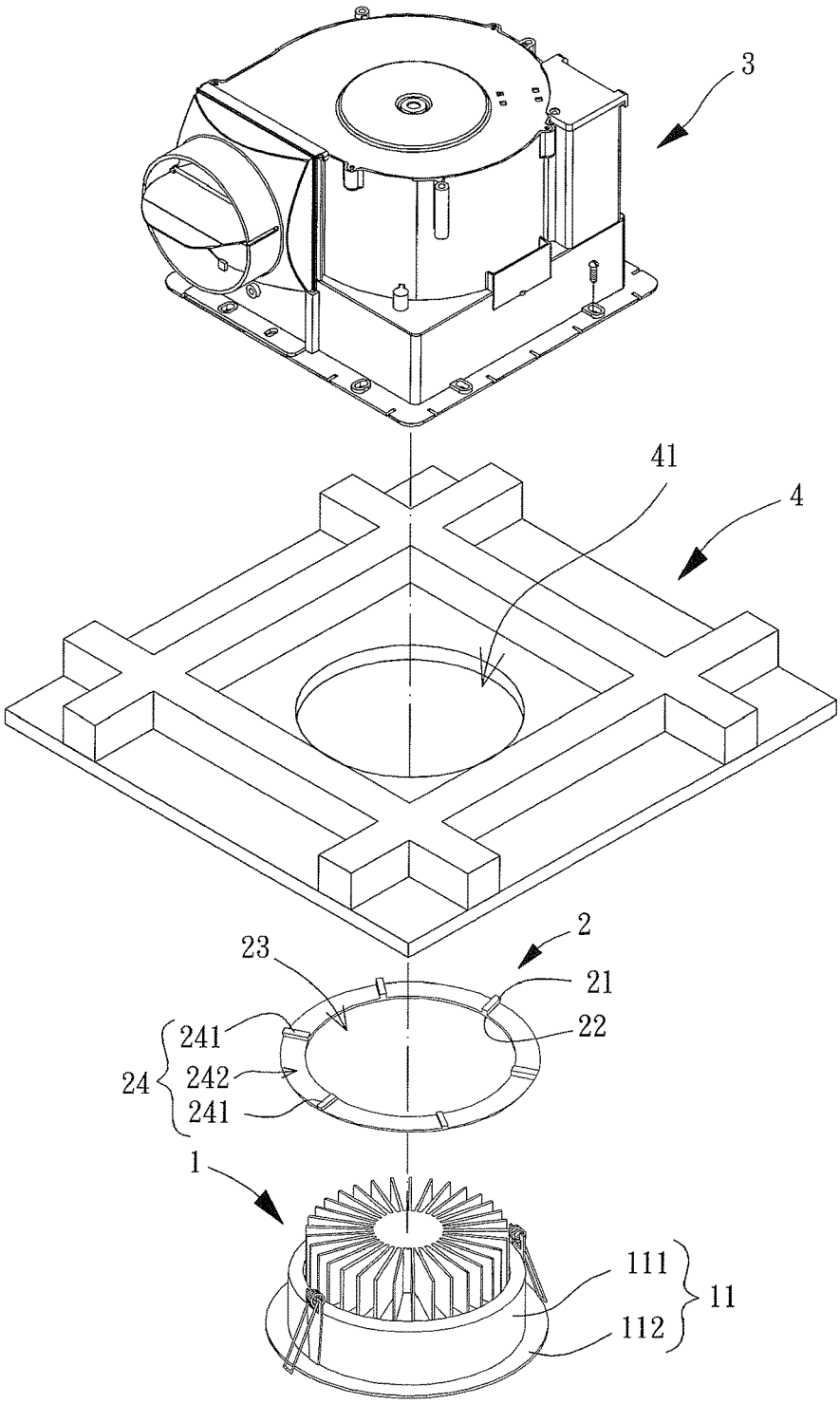
FIG. 4 is an exploded view of a lamp according to an embodiment of the invention.
Figure 5:
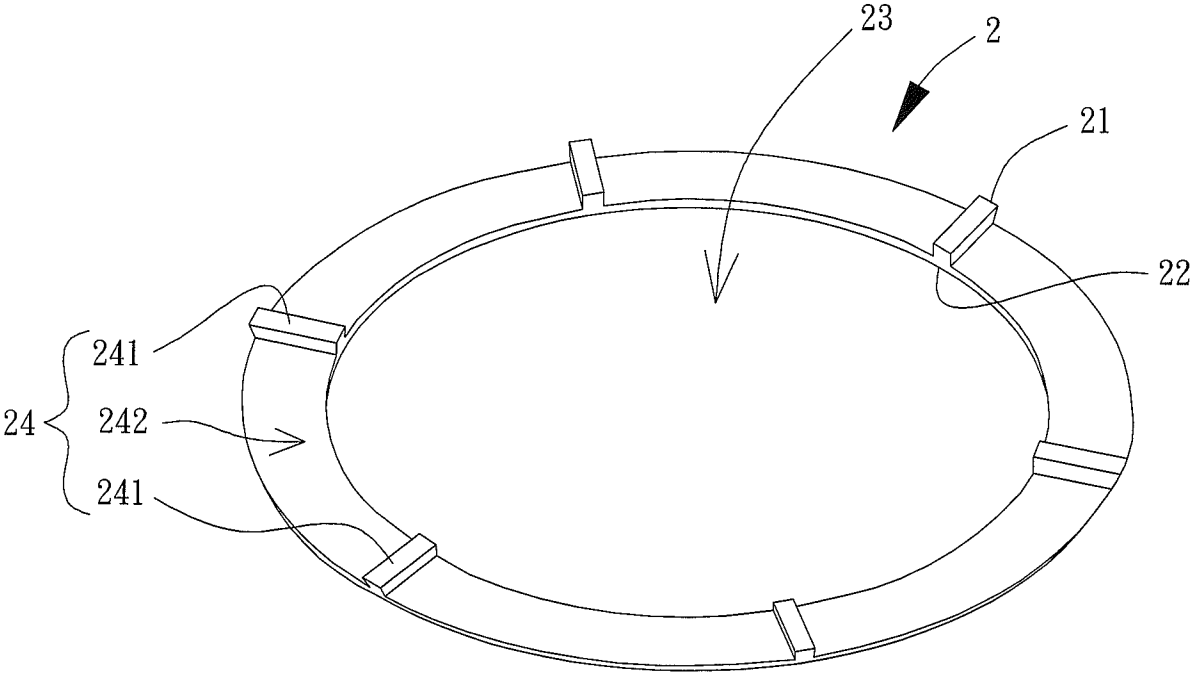
FIG. 5 shows an air-guiding ring of the lamp of the embodiment of the invention.

FIGS. 4 and 5 show a lamp including at least a lamp unit 1 and an air-guiding ring 2 according to an embodiment of the invention. Air-guiding ring 2 is fitted around lamp unit 1. In this embodiment, the lamp may include a fan 3 that is installed in a ceiling, a wall or other proper locations. In the embodiment shown in FIG. 4, the lamp may be installed in an installation hole 41 of a ceiling 4.

Figure 8:
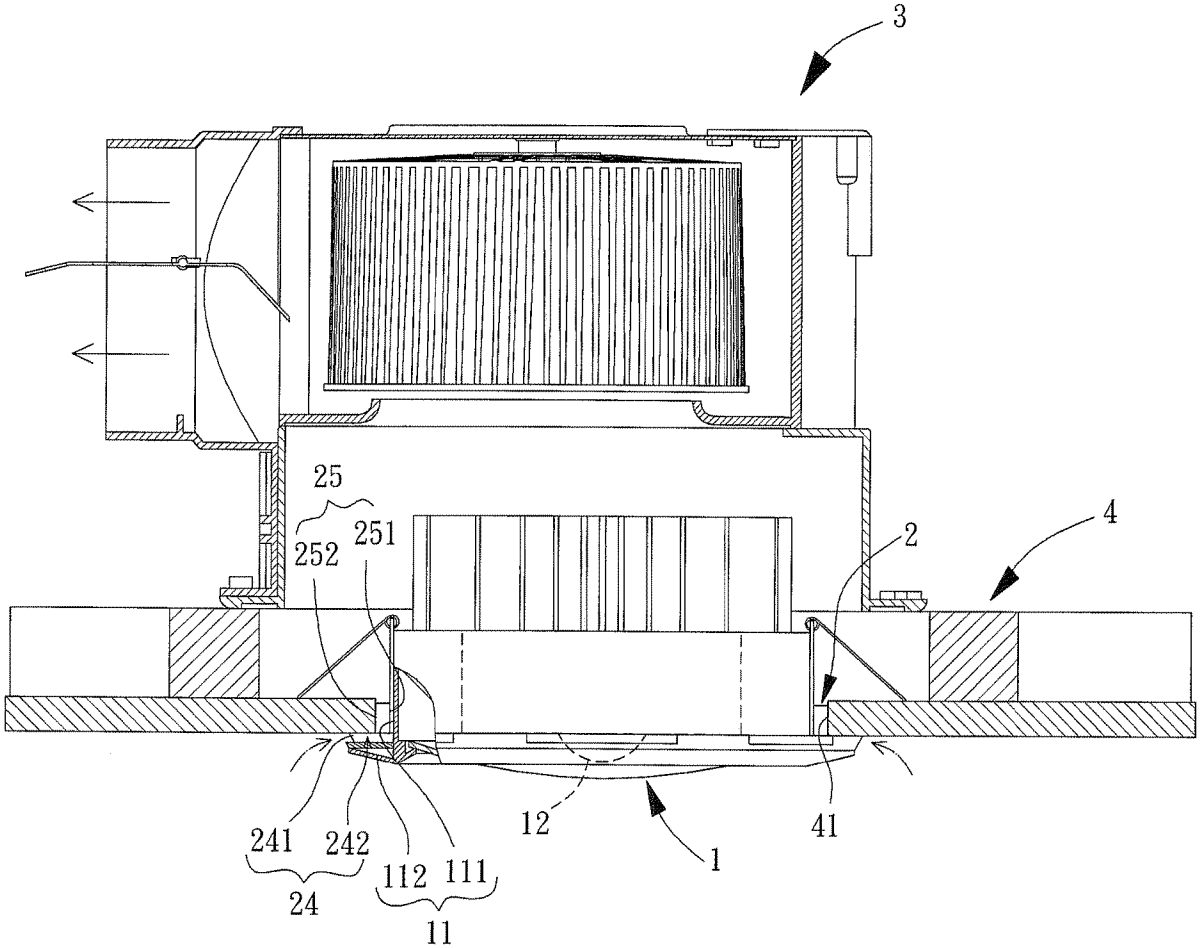
FIG. 8 is a cross sectional view of the lamp of the invention.

Lamp unit 1 includes a housing 11 receiving a light-emitting element 12 (as shown in FIG. 8) capable of emitting light. A fitted portion 111 is formed on an outer periphery of housing 11 in order to couple with air-guiding ring 2. Housing 11 may further include a decorative protrusion 112 adjoining the fitted portion 111, such that decorative protrusion 112 is able to cover air-guiding ring 2 when air-guiding ring 2 is fitted around lamp unit 1. Accordingly, a desired decorative function is provided.

Air-guiding ring 2 includes a first face 21 and a second face 22 opposite to first face 21. Air-guiding ring 2 includes an inner periphery forming a fitting hole 23, extending from first face 21 to second face 22. Air-guiding ring 2 can be fitted around the fitted portion 111 of lamp unit 1 via fitting hole 23. Air-guiding ring 2 may be preferably coupled with lamp unit 1 by loose fitting. Alternatively, air-guiding ring 2 may be coupled with lamp unit 1 by press fitting, adhesion, fastening, screwing or the like. The coupling mechanism between air-guiding ring 2 and lamp unit 1 is not limited to the above. Furthermore, air-guiding ring 2 further includes a venting portion 24 extending from an outer periphery to the inner periphery of air-guiding ring 2. Namely, venting portion 24 may extend from the outer periphery to fitting hole 23 of air-guiding ring 2.

Figure 6:
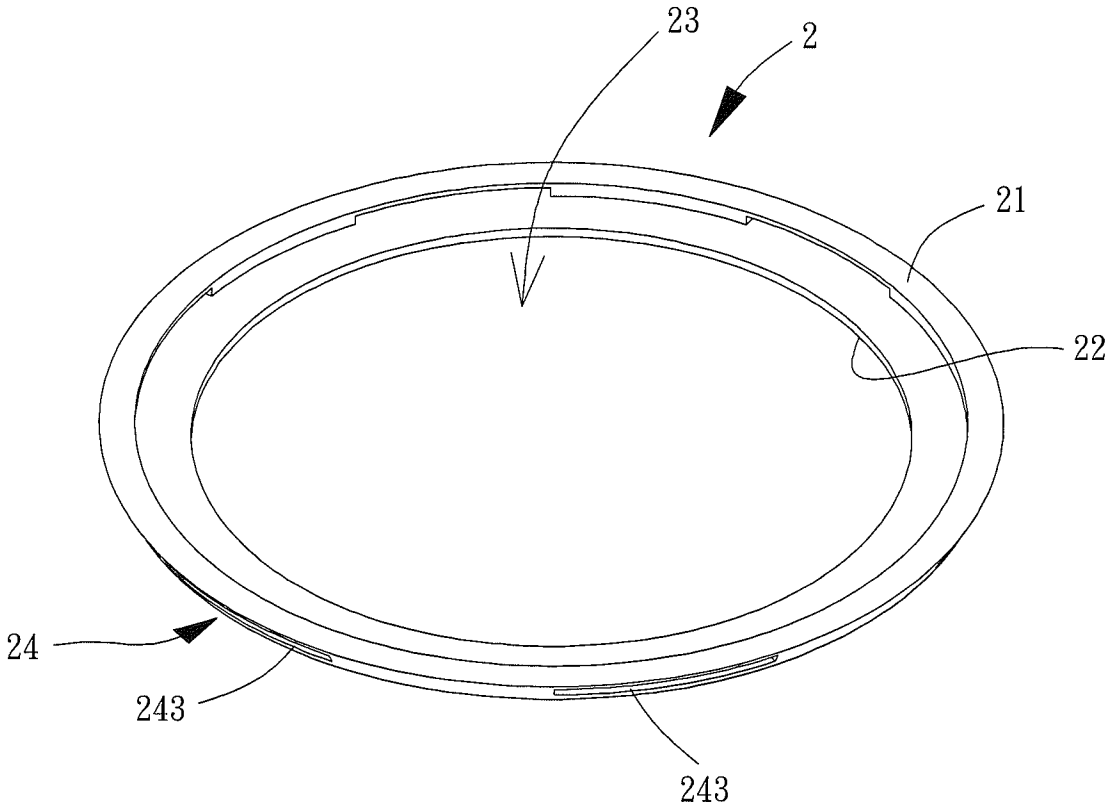
FIG. 6 shows an air-guiding ring of the lamp according to another embodiment of the invention.

Venting portion 24 of air-guiding ring 2 may be of any structure that extends from the outer periphery to the inner periphery of air-guiding ring 2. For example, venting portion 24 may be in the form of an opening or a slit that allows air to flow therethrough. In the embodiment of FIG. 5, air-guiding ring 2 may include a plurality of protrusions 241. The protrusions 241 are spaced from each other to form an opening 242 between two adjacent protrusions 241. Opening 242 extends from the outer periphery to the inner periphery of air-guiding ring 2. Alternatively, as shown in FIG. 6, venting portion 24 is in the form of a plurality of slits 243 extending from the outer periphery to the inner periphery of air-guiding ring 2.

Air-guiding ring 2 may be a plastic ring. Preferably, air-guiding ring 2 is a ring that can expand or shrink elastically (such as a rubber ring), so that air-guiding ring 2 can be easily fitted around the fitted portion 111 of housing 11 and enhance the coupling between air-guiding ring 2 and lamp unit 1.

Figure 7:
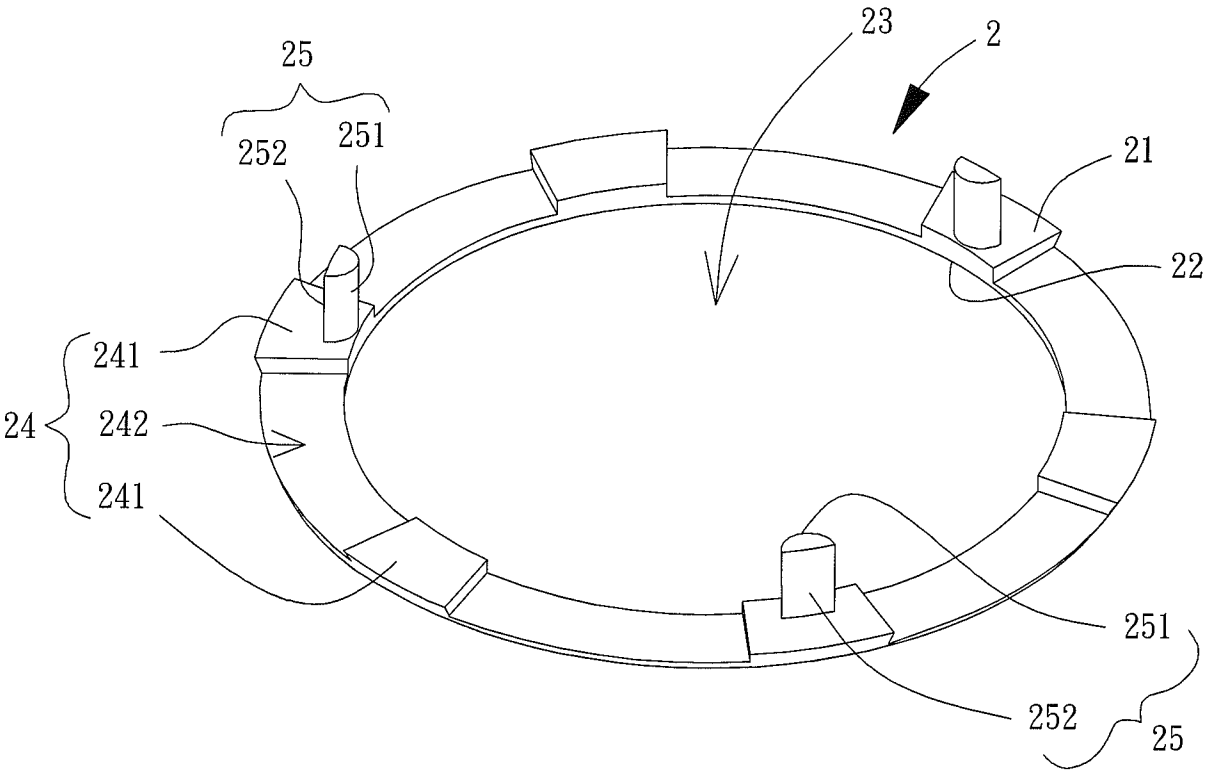
FIG. 7 shows an air-guiding ring of the lamp according to a further embodiment of the invention.

Referring to FIGS. 7 and 8, a plurality of positioning members 25 is preferably arranged on first face 21 of air-guiding ring 2. Each positioning member 25 includes an abutting face 251 and a coupling face 252 opposite to abutting face 251. Abutting face 251 may abut with the fitted portion 111 of housing 11. Coupling face 252 may abut with an inner periphery of ceiling 4 that forms installation hole 41. In addition, abutting face 251 is preferably in the form of an arc-like face in order not to scrape the surface of lamp unit 1 while lamp unit 1 is securely mounted in installation hole 41 of ceiling 4 via the plurality of positioning members 25.

Figure 9:
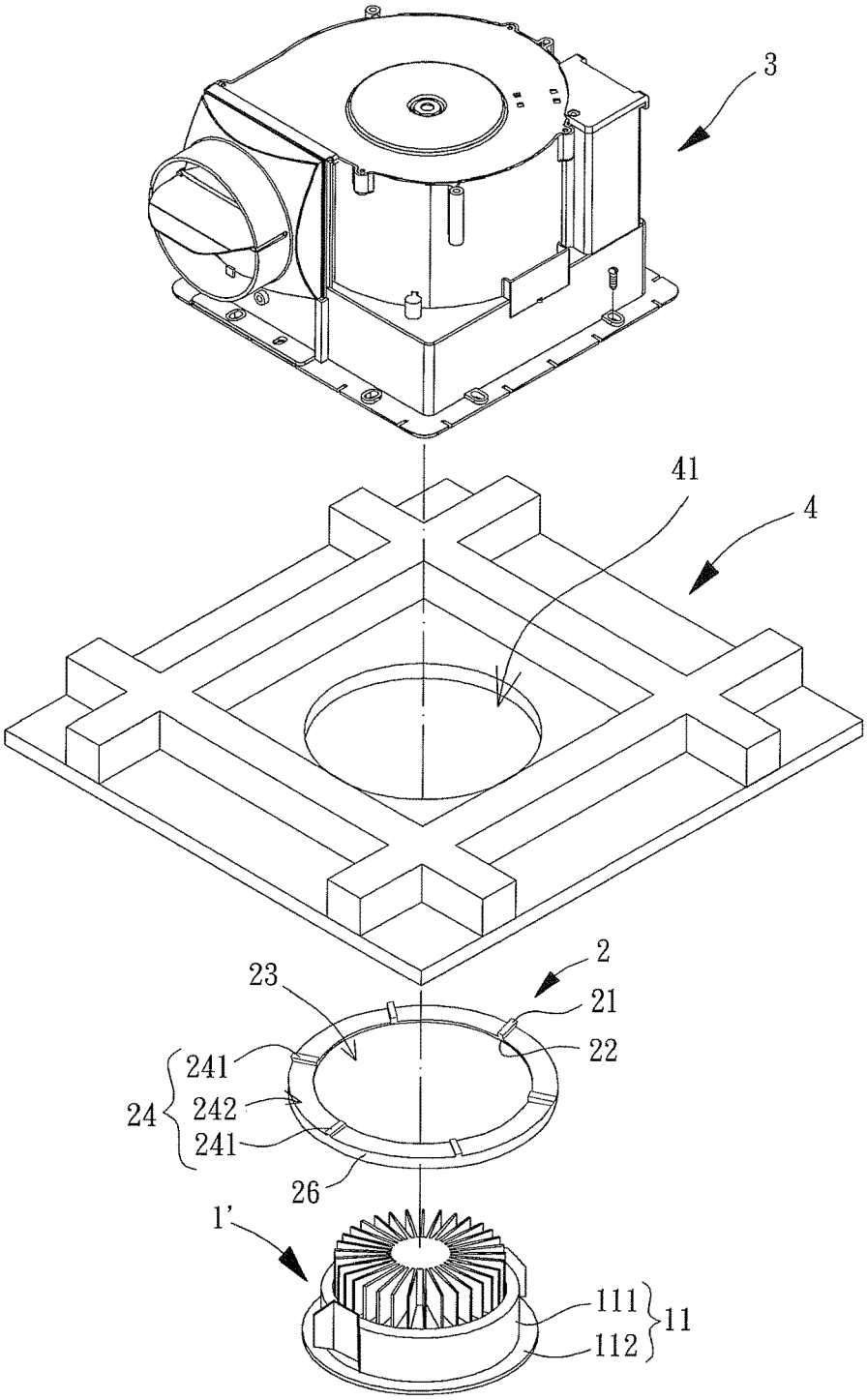
FIG. 9 is an exploded view of another type of lamp equipped with the air-guiding ring according to the invention.
Figure 10:
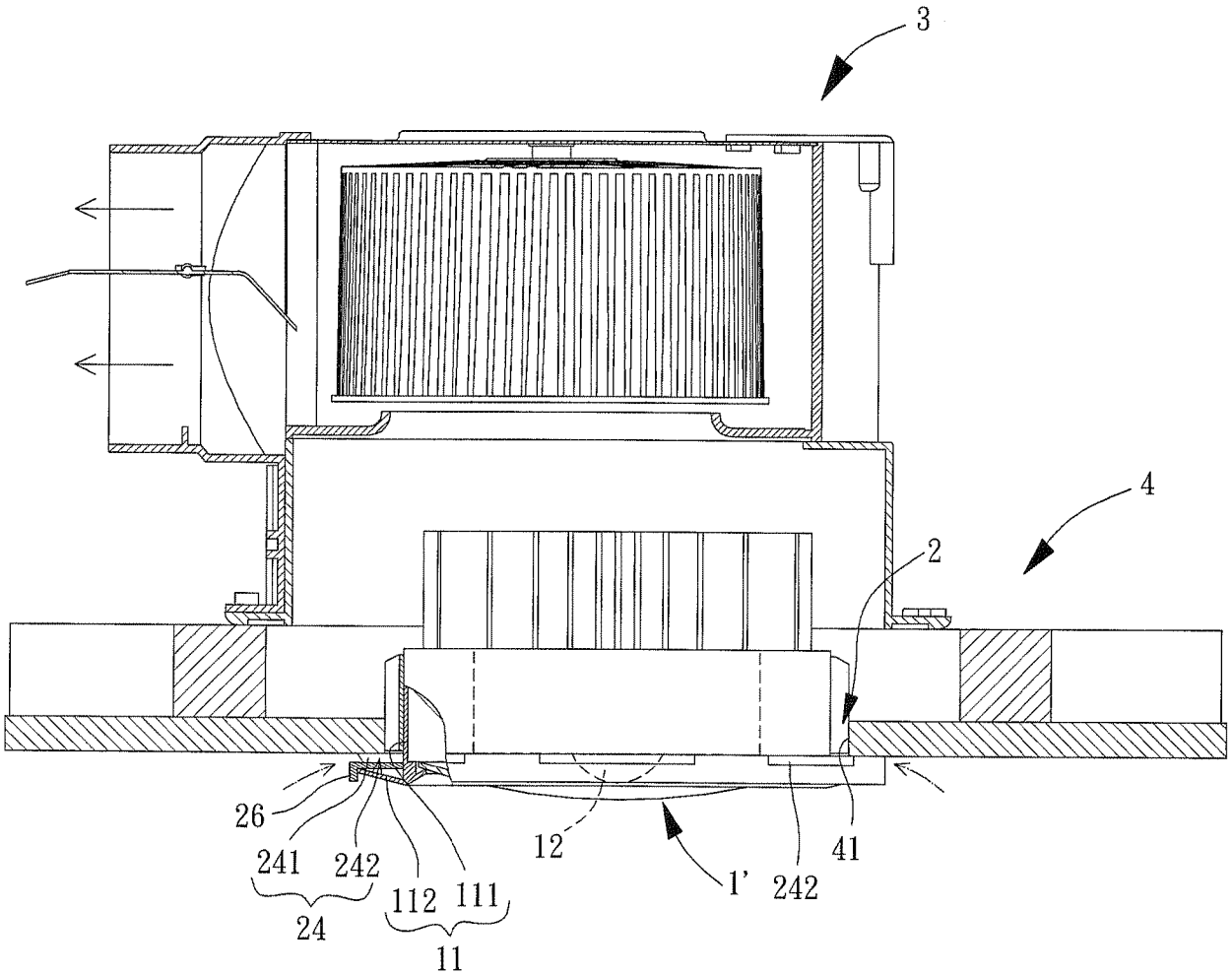
FIG. 10 is a cross sectional view of the lamp in FIG. 9.

Lamp unit 1 may have different types of appearances or structures. FIGS. 9 and 10 show a lamp unit 1' with another type of appearance or structure. Moreover, an outer cover 26 is preferably arranged on an outer periphery of air-guiding ring 2. Outer cover 26 extends in an axial direction perpendicular to the radial direction and can be used to cover an outer edge of decorative protrusion 112 for aesthetics when air-guiding ring 2 is fitted around the fitted portion 111 of lamp unit 1'.

Referring to FIGS. 8 and 10, during the use of the lamp, the lamp in the embodiment may be installed in a ceiling, a wall or other proper locations. For example, when the lamp is installed in ceiling 4, air-guiding ring 2 is fitted around the fitted portion 111 of lamp unit 1, 1' and fixed to installation hole 41, of ceiling 4. Air-guiding ring 2 may be fixed to installation hole 41 of ceiling 4 by press fitting, adhesion, fastening or screwing. Since air-guiding ring 2 has venting portion 24, an air channel can be formed between venting portion 24 and ceiling 4 for the air to pass through. In this regard, when fan 3 is installed in ceiling 4 (fan 3 may be directly affixed to ceiling 4 or directly coupled with lamp unit 1, 1'), fan 3 is able to guide the air into and out of the lamp via venting portion 24. As such, the desired ventilation effect is provided while the heat generated during the operation of the lamp is expelled, thereby prolonging the service life of the lamp.

Figure 11:
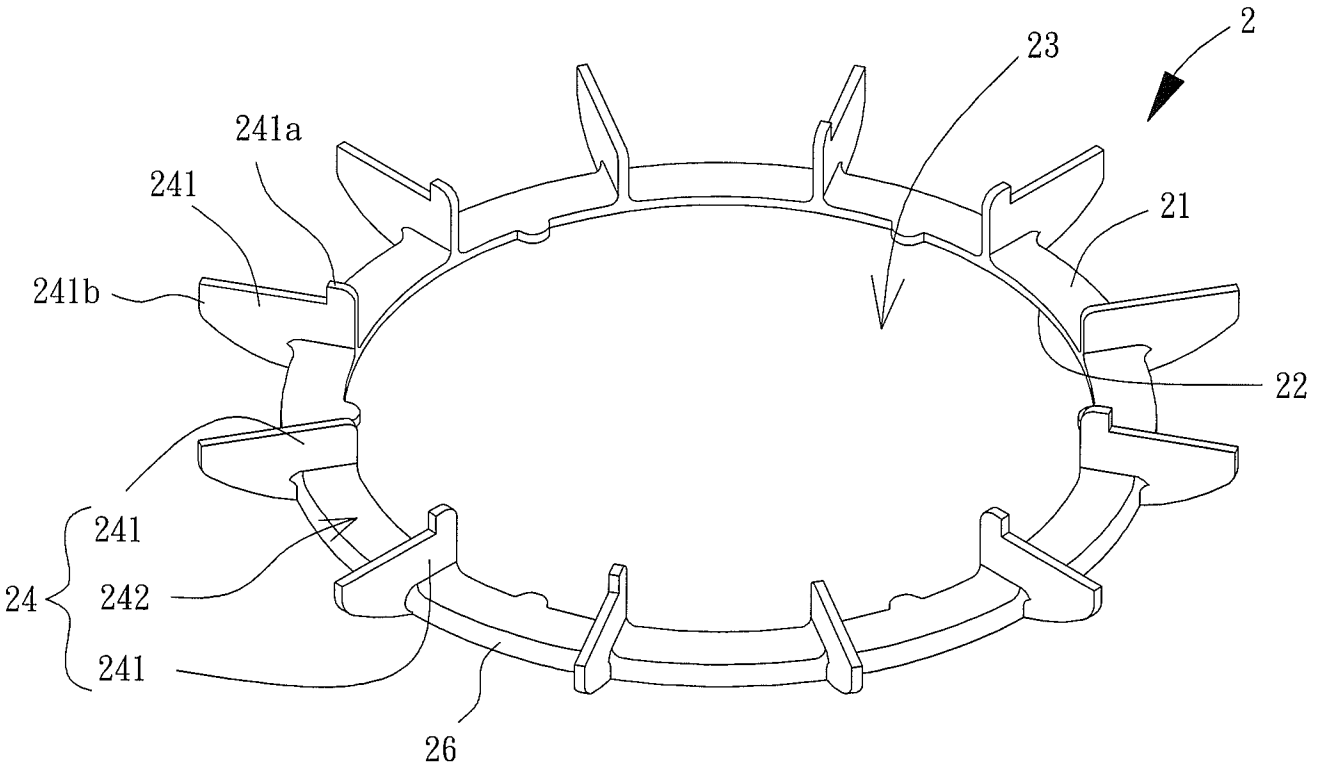
FIG. 11 shows an air-guiding ring having a plurality of protrusions according to a still further embodiment of the invention, with each protrusion comprising an abutting protrusion and a radial extension.
Figure 12:
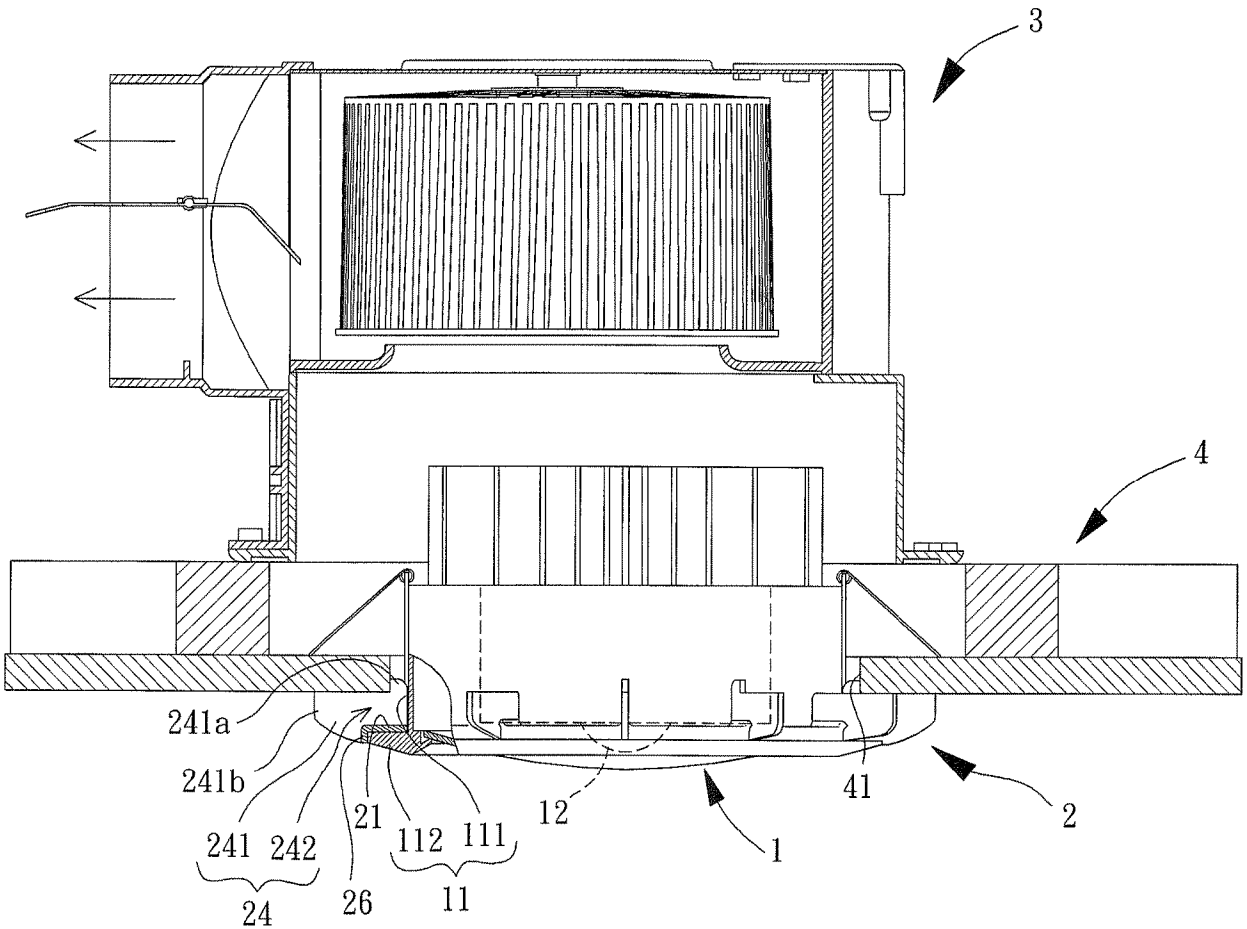
FIG. 12 is a cross-sectional view of a lamp equipped with the air-guiding ring of FIG. 11.

Referring to FIGS. 11 and 12, at least one of the plurality of protrusions 241 may include an abutting protrusion 241*a* adjacent to the inner periphery of air-guiding ring 2. In addition, at least one of the plurality of protrusions 241 may include a radial extension 241*b* extending outwards from the outer periphery of air-guiding ring 2 in a radial direction. In this arrangement, when lamp unit 1 is fixed at installation hole 41 of ceiling 4 via air-guiding ring 2, abutting protrusion 241*a* may couple with air-guiding ring 2, such that an edge of abutting protrusion 241*a* is adjacent to or aligned with the inner periphery of installation hole 41 of ceiling 4. Thus, an air channel may be formed between venting portion 24 and ceiling 4. Furthermore, radial extension 241*b* may increase the contact area between venting portion 24 and ceiling 4, and outer cover 26 may be coupled with decorative protrusion 112 of lamp unit 1 to effectively reinforce the coupling effect between air-guiding ring 2, ceiling 4 and lamp unit 1.

Based on the above structure of the lamp, air-guiding ring 2 can be easily fitted around lamp unit 1, 1' before the lamp is installed in installation hole 41 of ceiling 4. Due to this property, the installation of the lamp does not require complex procedures, thus reducing the assembly complexity of the lamp.

Furthermore, since the lamp in the embodiment is able to directly form the air channel between venting portion 24 and ceiling 4 when installed in installation hole 41 of ceiling 4, fan 3 can provide the desired ventilation effect simply using the venting portion 24 without having to drill extra vents on ceiling 4 in addition to installation hole 41. Advantageously, convenient use and cost reduction are attained.

Furthermore, air-guiding ring 2 can also be directly fitted around any kind of lamp with suitable structure (such as a sleeve-like lamp) without changing the structures of modem lamps. In this regard, fan 3 may also be used to provide a ventilation effect for improved utility.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A lamp comprising: a lamp unit having a housing, wherein a fitted portion is formed on an outer periphery of the housing; a light-emitting element received in the housing and located inside the fitted portion of the housing; and an air-guiding ring having an inner periphery forming a fitting hole, wherein the air-guiding ring comprises a venting portion extending from an outer periphery to the inner periphery of the air-guiding ring and a plurality of air channels extending from the outer periphery to the inner periphery and in fluid communication with the fitting hole, wherein the fitting hole of the air-guiding ring is fit around the fitted portion with the fitted portion blocking fluid communication between the plurality of air channels and the fitted portion to prevent air from flowing through the plurality of air channels into the fitted portion.

2. The lamp as claimed in claim 1, wherein the venting portion is in a form of a plurality of openings defining the plurality of air channels, wherein a plurality of protrusions protrudes from a face of the air-guiding ring extending between the inner periphery and the outer periphery, wherein the plurality of protrusions is spaced from each other to form a respective one of the plurality of openings between each two adjacent protrusions, and wherein the plurality of openings extends from the outer periphery to the inner periphery of the air-guiding ring.

3. The lamp as claimed in claim 2, wherein a plurality of positioning members is arranged on the air-guiding ring, wherein the plurality of positioning members is located on the plurality of protrusions, wherein each of the plurality of positioning members has an abutting face and a coupling face between the abutting face and the outer periphery of the air-guiding ring, wherein the abutting face abuts with the fitted portion of the housing, and wherein the coupling face is adapted to abut with an inner periphery of an installation hole of a ceiling.

4. The lamp as claimed in claim 3, wherein the abutting face is an arc-liking face.

5. The lamp as claimed in claim 2, wherein at least one of the plurality of protrusions includes an abutting protrusion, and wherein the abutting protrusion is closer to the inner periphery of the air-guiding ring than to the outer periphery of the air-guiding ring.

6. The lamp as claimed in claim 2, wherein at least one of the plurality of protrusions includes a radial extension extending outwards from the outer periphery of the air-guiding ring in a radial direction.

7. The lamp as claimed in claim 1, wherein the inner periphery and the outer periphery terminate in an upper peripheral edge and a lower peripheral edge, wherein the venting portion is in a form of a plurality of slits defining the plurality of air channels and extending from the outer periphery to the inner periphery of the air-guiding ring, and wherein each of the plurality of slits is located between and spaced from the upper peripheral edge and the lower peripheral edge.

8. The lamp as claimed in claim 1, wherein the lamp unit is coupled with a fan in fluid communication with the fitted portion and the plurality of air channels.

9. The lamp as claimed in claim 8, wherein the housing comprises a decorative protrusion adjoining the fitted portion and covering the air-guiding ring.

10. The lamp as claimed in claim 9, wherein an outer cover is arranged on the outer periphery of the air-guiding ring, wherein the outer cover is coupled with the decorative protrusion of the housing, wherein the outer cover extends away from the fan in an axial direction of the air-guiding ring, and wherein the outer cover is configured to guide air flow into the plurality of air channels.

11. The lamp as claimed in claim 8, wherein an outer cover is arranged on the outer periphery of the air-guiding ring, wherein the outer cover extends away from the fan in an axial direction of the air-guiding ring, and wherein the outer cover is configured to guide air flow into the plurality of air channels.

12. A lamp comprising:

a housing having a fitted portion and an annular protrusion extending radially from the fitted portion, with the fitted portion being annular and extending away from a first side of the annular protrusion in a first axial direction, and with the annular protrusion including an annular outer edge radially spaced from the fitted portion;

a light-emitting element received in the housing and located inside the fitted portion of the housing; and an air-guiding ring having an inner periphery forming a fitting hole and an outer periphery, with the air-guiding ring fit around the fitted portion of the lamp unit via the fitting hole and located in the first axial direction of and axially abutting with the first side of the annular protrusion in the first axial direction, and with the air-guiding ring including a venting portion extending from the outer periphery to the fitting hole of the air-guiding ring and a plurality of channels extending from the annular outer edge of the annular protrusion to the fitting hole of the air-guiding ring and in fluid communication with the fitting hole.

13. The lamp as claimed in claim 12, wherein the venting portion is in a form of a plurality of openings defining the plurality of air channels, wherein a plurality of protrusions protrudes from a face of the air-guiding ring in the first axial direction and between the inner periphery and the outer periphery, wherein the plurality of protrusions is spaced from each other to form a plurality of openings between each two adjacent protrusions, and wherein the plurality of openings extends from the outer periphery to the inner periphery of the air-guiding ring.

14. The lamp as claimed in claim 13, wherein a plurality of positioning members is arranged on the air-guiding ring, wherein the plurality of positioning members is located on the plurality of protrusions, wherein each of the plurality of positioning members has an abutting face and a coupling face between the abutting face and the outer periphery of the air-guiding ring, wherein the abutting face abuts with the fitted portion of the housing, and wherein the coupling face is adapted to abut with an inner periphery of an installation hole of a ceiling.

15. The lamp as claimed in claim 12, wherein the inner periphery and the outer periphery terminate in an upper peripheral edge and a lower peripheral edge, wherein the venting portion is in a form of a plurality of slits defining the plurality of air channels and extending from the outer periphery to the inner periphery of the air-guiding ring, and wherein each of the plurality of slits is located between and spaced from the upper peripheral edge and the lower peripheral edge.

16. The lamp as claimed in claim 12, further comprising a fan in fluid communication with the fitted portion and the plurality of air channels.

17. The lamp as claimed in claim 16, further comprising an outer cover arranged on the outer periphery of the air-guiding ring, wherein the outer cover is coupled with the annular protrusion of the housing, wherein the outer cover extends away from the fan in a second axial direction opposite to the first axial direction, and wherein the outer cover is configured to guide air flow into the plurality of air channels.

18. The lamp as claimed in claim 17, wherein each of the plurality of channels extends radially parallel to the annular protrusion.

* * * * *